US009999961B2

(12) United States Patent
Mizuura et al.

(10) Patent No.: US 9,999,961 B2
(45) Date of Patent: Jun. 19, 2018

(54) GRINDING MACHINE

(71) Applicant: NSK Ltd., Tokyo (JP)

(72) Inventors: Kengou Mizuura, Fujisawa (JP); Tetsuya Gotou, Fujisawa (JP); Miyuki Maruyama, Fujisawa (JP)

(73) Assignee: NSK Ltd., Tokyo (JP)

( * ) Notice: Subject to any disclaimer, the term of this patent is extended or adjusted under 35 U.S.C. 154(b) by 237 days.

(21) Appl. No.: 14/898,096

(22) PCT Filed: Jun. 6, 2014

(86) PCT No.: PCT/JP2014/065135
§ 371 (c)(1),
(2) Date: Dec. 11, 2015

(87) PCT Pub. No.: WO2014/199927
PCT Pub. Date: Dec. 18, 2014

(65) Prior Publication Data

US 2016/0121459 A1 May 5, 2016

(30) Foreign Application Priority Data

Jun. 11, 2013 (JP) ..... 2013-122503

(51) Int. Cl.
*B24B 5/24* (2006.01)
*B24D 5/00* (2006.01)
(Continued)

(52) U.S. Cl.
CPC ..... *B24D 5/00* (2013.01); *B24B 5/22* (2013.01); *B24B 5/24* (2013.01); *B24B 5/307* (2013.01); *B24B 7/16* (2013.01)

(58) Field of Classification Search
CPC ..... B24B 5/24
(Continued)

(56) References Cited

U.S. PATENT DOCUMENTS 4,062,150 A * 12/1977 Masuda ..... B24B 5/18 451/242
4,178,719 A * 12/1979 Jessup ..... B24B 5/24 451/245
(Continued)

FOREIGN PATENT DOCUMENTS

JP 62-148147 A 7/1987
JP 4-109848 U 9/1992
(Continued)

OTHER PUBLICATIONS

International Search Report from International Patent Application No. PCT/JP2014/065135, dated Jul. 22, 2014.

*Primary Examiner* — Robert Rose
(74) *Attorney, Agent, or Firm* — Shapiro, Gabor and Rosenberger, PLLC

(57) ABSTRACT

Provided is a grinding machine that does not require work for replacing an upper roller (12) and a lower roller (14) and that ensures interchangeability thereof, even when the outer diameter of a workpiece (W) and the inclination state of the generating line of the workpiece (W) are different. A headstock (7) of the grinding machine comprises an upper-roller device (13) on which the upper roller (12) is rotatably supported, and a lower-roller device (15) on which the lower roller (14) is rotatably supported. The upper-roller device (13) and the lower-roller device (15) are provided with vertical position adjustment mechanisms (22), (46), respectively, for modifying the height position related to the vertical direction thereof, and a turn angle adjustment mechanism (21) for modifying the inclination angles of the upper-roller device (13) and the lower-roller device (15) with respect to the horizontal direction of the center axes thereof.

7 Claims, 10 Drawing Sheets

(51) Int. Cl.
*B24B 5/22* (2006.01)
*B24B 5/307* (2006.01)
*B24B 7/16* (2006.01)

(58) Field of Classification Search
USPC ..... 451/194, 49, 5, 8–10, 331, 172
See application file for complete search history.

(56) References Cited

U.S. PATENT DOCUMENTS

| | | | | |
|---|---|---|---|---|
| 5,123,213 | A * | 6/1992 | Vinson | B24B 5/355 451/13 |
| 2003/0236058 | A1 * | 12/2003 | Kamamura | B24B 5/01 451/49 |

FOREIGN PATENT DOCUMENTS

| | | | |
|---|---|---|---|
| JP | 8-155800 | A | 6/1996 |
| JP | 10-328984 | A | 12/1998 |
| JP | 11-77494 | A | 3/1999 |
| JP | 2000-117600 | A | 4/2000 |
| JP | 2002-283196 | A | 10/2002 |
| JP | 2005-088167 | A | 4/2005 |
| JP | 2009-136953 | A | 6/2009 |

* cited by examiner 15
60
61
62
59
46
63
64
56
57
45
55
53
54
43
67
58
52
29
16
14
18
17
$O_{14}$
51
44
50
48
49

GRINDING MACHINE

TECHNICAL FIELD

The present invention relates to a grinding machine that is used for grinding the circumferential surface or end surface of a workpiece having a circular column shape, a conic trapezoidal shape, or a cylindrical shape such as a roller or bearing rings of a rolling bearing.

BACKGROUND ART

As a grinding machine for grinding the circumferential surface or end surface of a workpiece having a circular column shape, conic trapezoidal shape, or cylindrical shape, or in other words, having an outer circumferential surface with a circular cross-sectional shape, such as a roller (cylindrical roller or conical roller) or bearing rings of a rolling bearing, a so-called centerless grinding machine that performs grinding of a workpiece while holding the outer-circumferential surface of the workpiece using rollers or shoe is known, referring to JPS62148147 (A) and JP2009136953 (A). FIG. 9 and FIG. 10 illustrate an example of conventional construction of a 2 roller 1 shoe type of such a centerless grinding machine.

The grinding machine 1 comprises an upper roller 2 and a lower roller 3 that are arranged on both the top and bottom sides of a circular column shaped workpiece W. In a state that the center axes of the upper roller 2 and the lower roller 3 are arranged in the horizontal direction and in parallel to each other, the upper roller 2 and the lower roller 3 rotate at the same speed in the same direction so that the workpiece W is rotated in a state of being supported from both the top and bottom sides. Moreover, in order to simplify the supply and output of a workpiece W, the upper roller 2 is supported so as to be able to rock in the vertical direction about a rocking center (not illustrated in the figure), and presses the workpiece W that is arranged below the upper roller 2 toward the lower roller 3 using the elastic force of a spring (not illustrated in the figure). On the other hand, the lower roller 3 is supported so as to be able to rotate only around the center axis of the lower roller 3, and is not able to move. A shoe 4 is arranged between the upper roller 2 and the lower roller 3 in the vertical direction so as to extend in a direction that is orthogonal to the center axes of the upper roller 2 and lower roller 3. The shoe 4 is such that the tip-end surface thereof comes in contact with the outer-circumferential surface of the workpiece W, and supports the workpiece W from the side. Moreover, a backing plate 5 is arranged on one side in the axial direction of the workpiece W, and one end surface in the axial direction of the workpiece W butts against the backing plate 5. The workpiece W is rotated around the center axis that is arranged in the horizontal direction while being held in the processing position by the upper roller 2, lower roller 3, shoe 4 and backing plate 5. In this state, the outer-circumferential surface or end surface of the workpiece W is ground by a rotating grindstone 6 that is arranged on the other end side in the axial direction of the workpiece W.

In the case of a grinding machine 1 having conventional construction, due to the low degree of freedom of movement of the upper roller 2 and lower roller 3, it is necessary to prepare plural upper rollers 2 and lower rollers 3 having different sizes and shapes according to the type of workpiece W, specifically, kind and size of each component of a bearing.

FIG. 11A to FIG. 11C illustrate the state of performing grinding of three kinds of workpieces W1, W2, W3 using a conventional grinding machine. Workpiece W1 has a large-diameter circular column shape, workpiece W2 has a circular column shape with a smaller diameter than workpiece W1, and workpiece W3 has a conic trapezoidal shape, the inclination of the generating line thereof being different than that of workpiece W1. In the grinding machine 1, the upper roller 2 is capable of only rocking displacement in the vertical direction, and the lower roller 3 is fastened so that movement is not possible, so the upper roller 2A and lower roller 3A illustrated in FIG. 11A that are suitable for the grinding of workpiece W1 and that have a small diameter, the outer diameter of which does not change along the axial direction, cannot be used for processing workpiece W2 and workpiece W3; the upper roller 2B and lower roller 3B illustrated in FIG. 11B that are suitable for the grinding of workpiece W2 and that have a large diameter, the outer diameter of which does not change along the axial direction, cannot be used for processing workpiece W1 and workpiece W3; and the upper roller 2C and lower roller 3C that are suitable for the grinding of workpiece W3, the outer diameter of which changes along the axial direction (the outer-circumferential surface is a partial conical convex surface), cannot be used for processing workpiece W1 and workpiece W2. In this way, in the grinding machine 1, every time the outer diameter and the inclination state of the generating line differ, it is necessary to prepare an upper roller 2 (2A to 2C) and a lower roller 3 (3A to 3C) that are suitable for the respective grinding. Therefore, particularly on a production line for producing various kinds of small rods, it is not possible to avoid an increase in the amount of labor and time for replacing the rollers. Management of the roller diameter (outer diameter) and performance such as wear resistance are strictly required for the upper roller 2 and lower roller 3, and are very expensive. Therefore, having to prepare special rollers for each workpiece, also poses a problem from the aspect of manufacturing cost.

Moreover, in the conventional grinding machine 1, a workpiece W that is placed underneath the upper roller 2 is pressed toward the lower roller 3 by the elastic force of a spring. The pressure force by the upper roller 2 is constant according to the elastic force of the spring (physical characteristics such as the length and wire diameter of the spring), so in order to change the pressure force by the upper roller 2, it is necessary to replace the spring with a different spring. In JPS62148147 (A), a grinding machine is disclosed in which it is possible to appropriately change the pressure force by the upper roller. However, in this grinding machine, a special and complex mechanism is required just for changing the pressure force, so it is not possible to avoid an increase in size and manufacturing cost of the grinding machine.

RELATED LITERATURE

Patent Literature

[Patent Literature 1] JPS62148147 (A)
[Patent Literature 2] JP2009136953 (A)

SUMMARY OF INVENTION

Problem to be Solved by Invention

Taking the above situation into consideration, the object of the present invention is to provide a grinding machine for which the rollers are made common, and there is no need for replacing the upper roller and lower roller even when the outer diameters or inclination angles of the generating lines of the workpieces being grinded differ.

Means for Solving Problems

The grinding machine of the present invention, similar to the grinding machine having conventional construction, comprises an upper roller, a lower roller and a shoe, and is used for performing a grinding process on a circumferential surface (outer-circumferential surface or inner-circumferential surface) or end surface (end surface in the axial direction) of a workpiece, the cross-sectional shape of the outer circumferential surface of the workpiece being a circular shape. Of these, the upper roller and lower roller rotates in the same direction as each other in a state that the upper roller and the lower roller support the workpiece from both the upper and lower sides, to rotate the workpiece. On the other hand, the shoe is positioned in the vertical direction between the upper roller and the lower roller, and supports the workpiece from the side by abutting the tip-end surface of the shoe against the outer-circumferential surface of the workpiece.

Particularly, the grinding machine of the present invention comprises: a vertical position adjustment mechanism for respectively changing the height position in the vertical direction of both the upper roller and lower roller; and an angle adjustment mechanism for respectively changing the inclination angle with respect to the horizontal direction of the center axes of both the upper roller and the lower roller. In other words, a vertical position adjustment mechanism and an angle-adjustment mechanism can be provided for both the upper roller and the lower roller, or in other words, two each can be provided for the overall grinding machine, or it is also possible to make the vertical position adjustment mechanism and angle-adjustment mechanism common for both the upper roller and lower roller, and to provide one each for the overall grinding machine.

Preferably, each vertical position adjustment mechanism and angle adjustment mechanism comprises a servo motor, and automatically changes the height position in the vertical direction of the upper roller and lower roller, and changes the inclination angle with respect to the horizontal direction of the center axes of the upper roller and lower roller according to the outer diameter and inclination state (whether or not there is inclination with respect to the center axes, and when there is inclination, the angle of inclination) of the generating line of the workpiece.

Furthermore, preferably, the vertical position adjustment mechanism controls the pressure force of the upper roller on the workpiece by using torque control to control the torque of the servo motor of the vertical position adjustment mechanism.

Effect of Invention

With the grinding machine of the present invention, it is possible to make the rollers common even when the outer diameters and inclination states of the generating lines of the objects to be ground differ, so it is possible to eliminate the need for replacement work to replace the upper roller and lower roller.

In other words, the grinding machine of the present invention comprises a vertical position adjustment mechanism for changing the height position in the vertical direction of the upper roller and the lower roller, and so it is possible to appropriately change the height position in the vertical direction of the upper roller and lower roller according to the outer diameter of the workpiece, so even when the outer diameters of workpieces differ, there is no need to perform replacement work to replace the upper roller and lower roller. Moreover, the grinding machine of the present invention comprises an inclination angle adjustment mechanism for changing the inclination angle with respect to the horizontal direction of the center axes of the upper roller and lower roller, and it is possible to appropriately change the inclination angle with respect to the horizontal direction of the center axes of the upper roller and lower roller, so even when the inclination angles of the generating lines of workpieces differ, there is no need to perform replacement work to replace the upper roller and lower roller.

As a result, with the present invention, the upper roller and the lower roller can be made common, and when the outer diameters or the inclination states of the generating lines of workpieces differ, there is no need to perform replacement work to replace the upper roller and lower roller. Therefore, even on a production line for producing various kinds of small rod products, there is no need to prepare plural upper rollers and lower rollers, and it possible to omit the work of replacing rollers. Consequently, it is possible to suppress a rise in manufacturing costs due to preparing plural rollers, and it is also possible to reduce the number work steps and work time.

MODES FOR CARRYING OUT INVENTION

Example of an Embodiment

Figure 1:
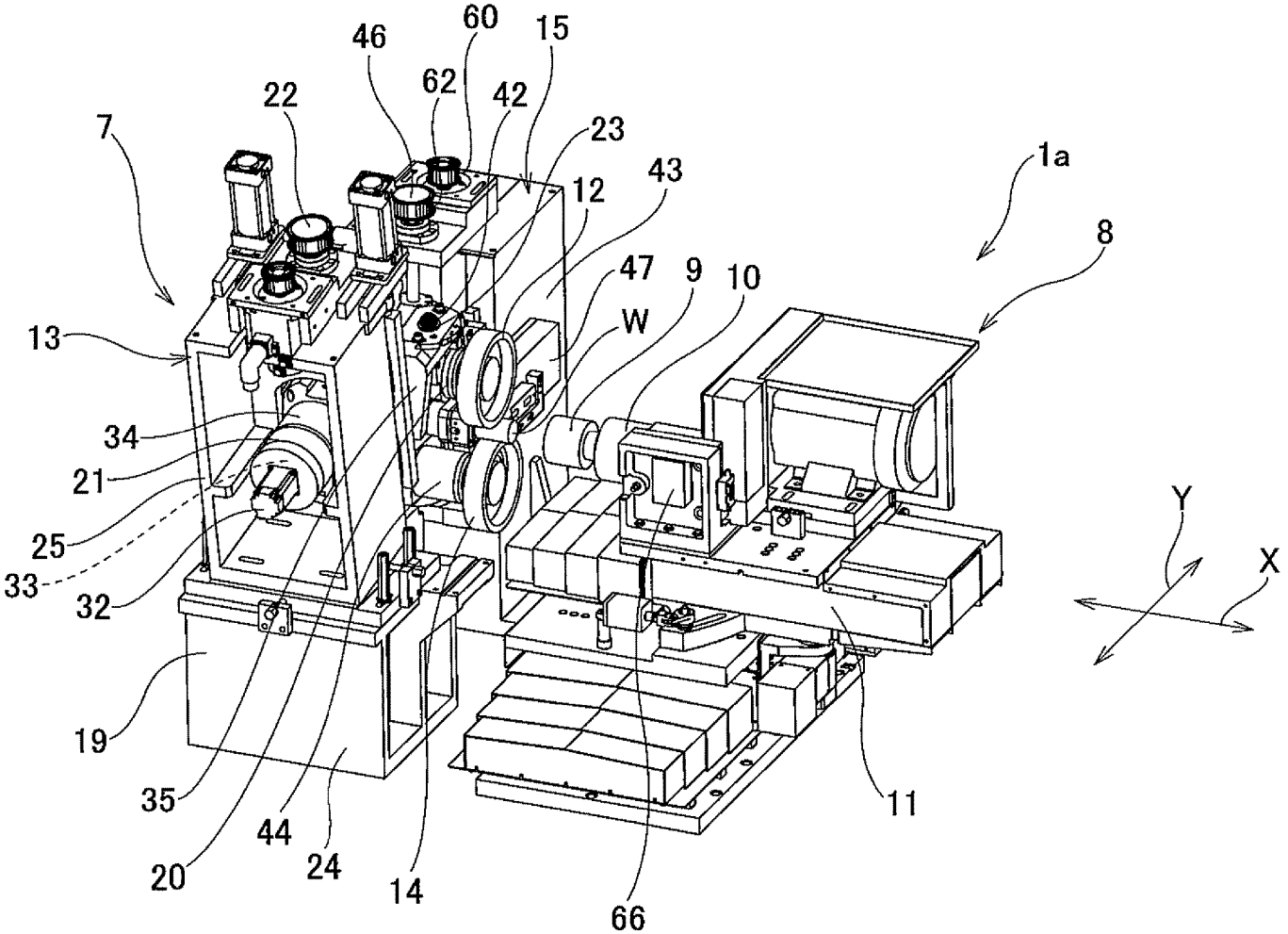
FIG. 1 is a perspective view illustrating a grinding machine of a first example of an embodiment of the present invention.
Figure 2:
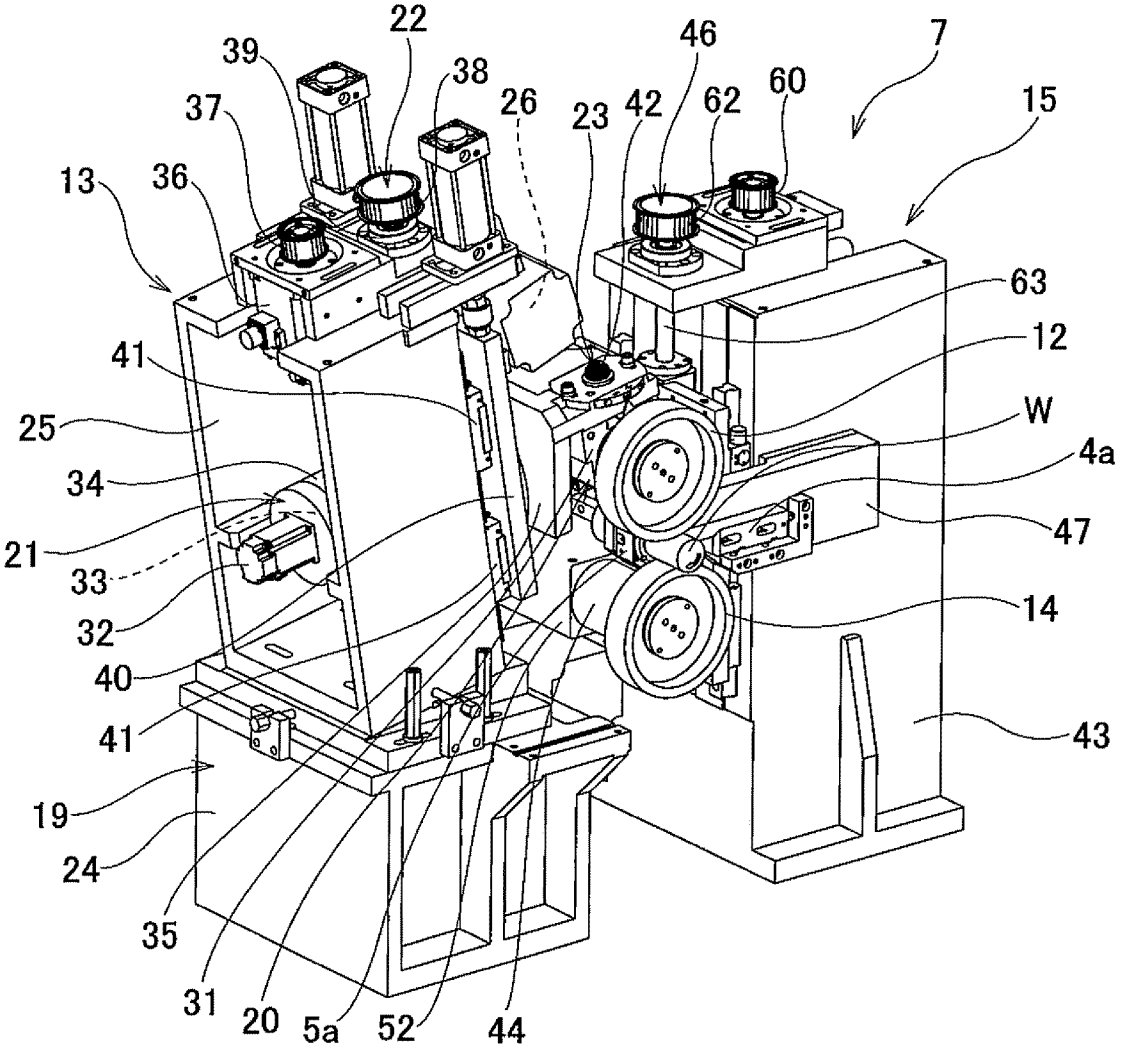
FIG. 2 is a perspective view illustrating the headstock that has been removed from the grinding machine in FIG. 1.
Figure 3:
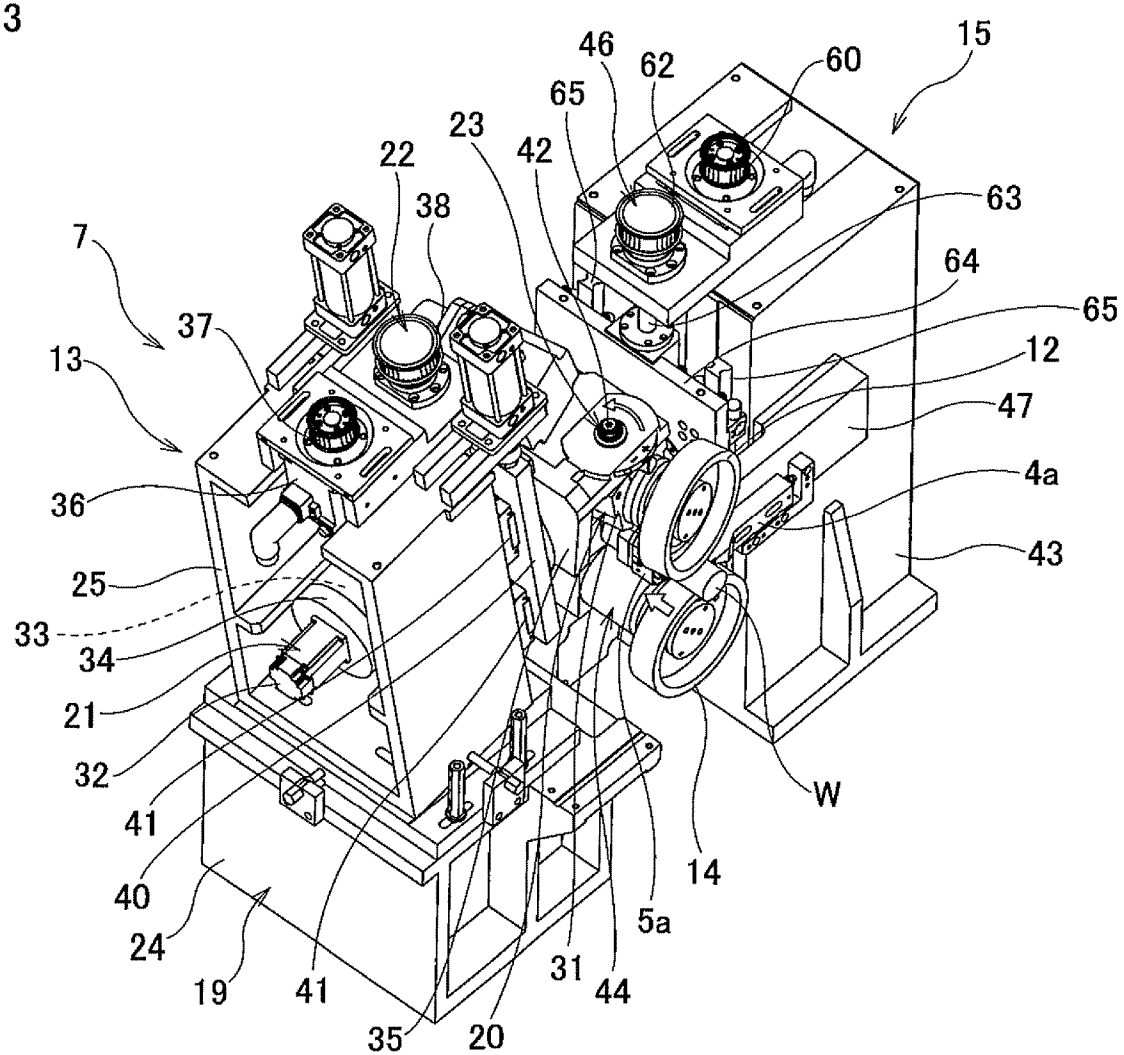
FIG. 3 is a perspective view illustrating the headstock in FIG. 2 as seen from a different angle than in FIG. 2.
Figure 4:
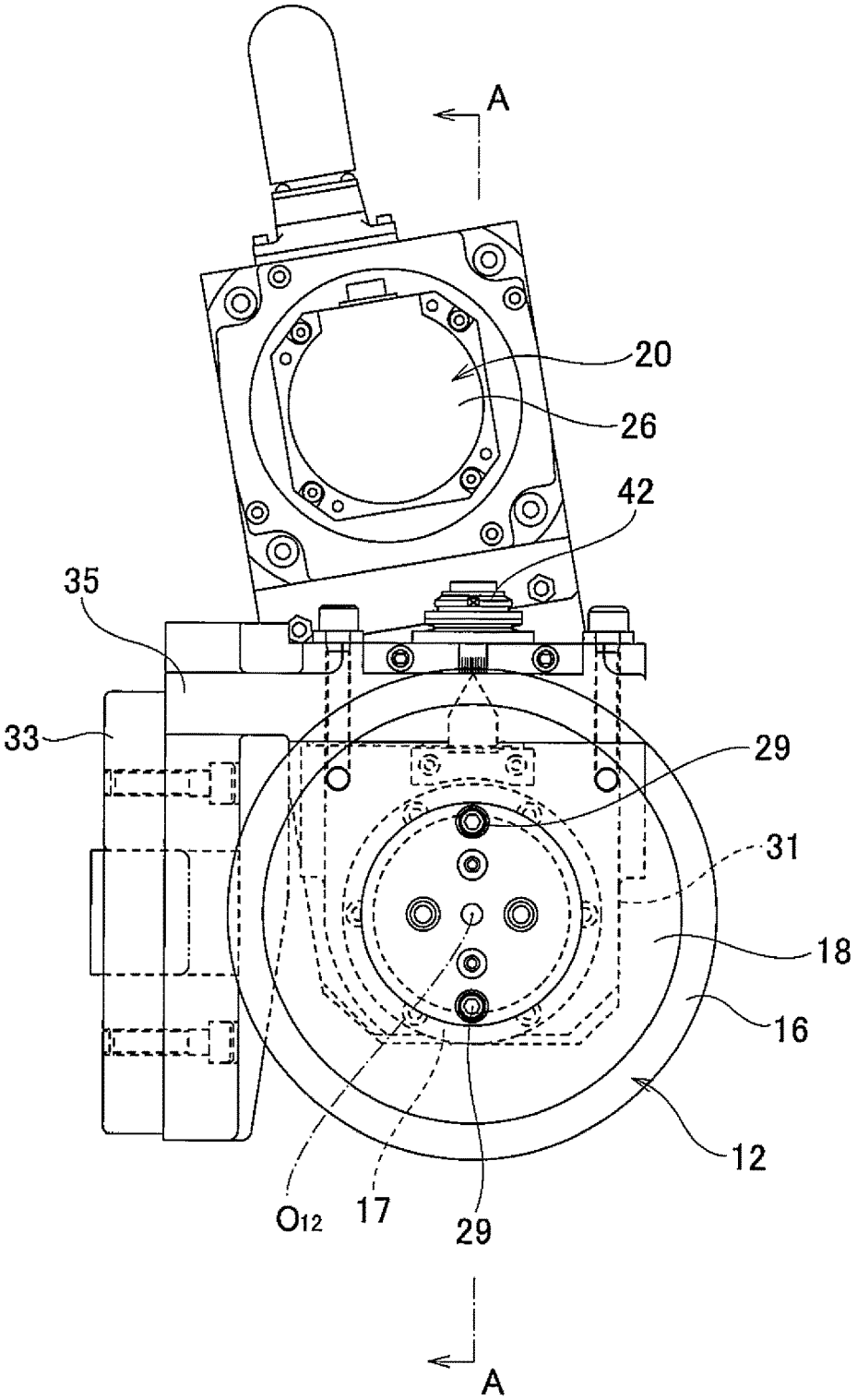
FIG. 4 is a front view of part of the upper-roller device that has been removed from the grinding machine in FIG. 1.

FIG. 1 to FIG. 8 illustrate an example of an embodiment of the present invention. The grinding machine 1*a* of this example, as in the case of the grinding machine 1 having conventional construction, is a 2 roller 1 shoe type grinding machine and comprises an upper roller 12, a lower roller 14 and a shoe 4*a*, and is used for performing a grinding process on the circumferential surface (outer-circumferential surface or inner-circumferential surface) or the end surfaces (end surfaces in the axial direction) of a workpiece W, the cross-sectional shape of the outer-circumferential surface thereof being a circular shape. Of these, the upper roller 12 and lower roller 14 support the workpiece W from both the top and bottom side, and rotate in the same direction as each other, causing the workpiece W to rotate. On the other hand, the shoe 4*a* is positioned in the vertical direction between the upper roller 12 and the lower roller 14, and the tip-end surface thereof comes in contact with the outer-circumferential surface of the workpiece W to support the workpiece W from the side.

More specifically, the grinding machine 1*a* of this example comprises a headstock 7 and grindstone base 8. The grindstone base 8 comprises: a cup grindstone 9 that grinds the end surface of a workpiece W; a grindstone spindle 10 that rotates and drives the cup grindstone 9, and an X-Y table 11 that moves the cup grindstone 9 and grindstone spindle 10 in an X direction that is parallel to the axial direction of the workpiece W and a Y direction that is orthogonal to the X direction. Moreover, a controller 66 for controlling the grinding machine 1*a* is provided in the grindstone base 8.

The headstock 7 is for supporting the workpiece W so as to be able to rotate, and is formed by combining together an upper-roller device 13 that supports the upper roller 12 so as to be able to rotate freely, and a lower-roller device 15 that supports the lower roller 14 so as to be able to rotate freely. In this example, the upper roller 12 and lower roller 14 have the same shape, with each having a stepped cylindrical shape and formed by connecting a large-diameter cylindrical section 16 and a small-diameter cylindrical section 17 by a circular ring shaped stepped section 18. The outer-circumferential surface of the large-diameter cylindrical section 16 that becomes the supporting surface for supporting the workpiece W is a simple cylindrical surface of which the outer diameter does not change in the axial direction.

The upper-roller device 13 comprises a base 19, a rotation drive mechanism 20, a turn angle adjustment mechanism 21, a vertical position adjustment mechanism 22, and a skew angle adjustment mechanism 23. The base 19 comprises a pedestal 24 that is fastened to the floor, and a rectangular frame shaped support frame 25 that is fastened to the top surface of the pedestal 24 so as to be inclined a little with respect to the vertical direction.

Figure 5:
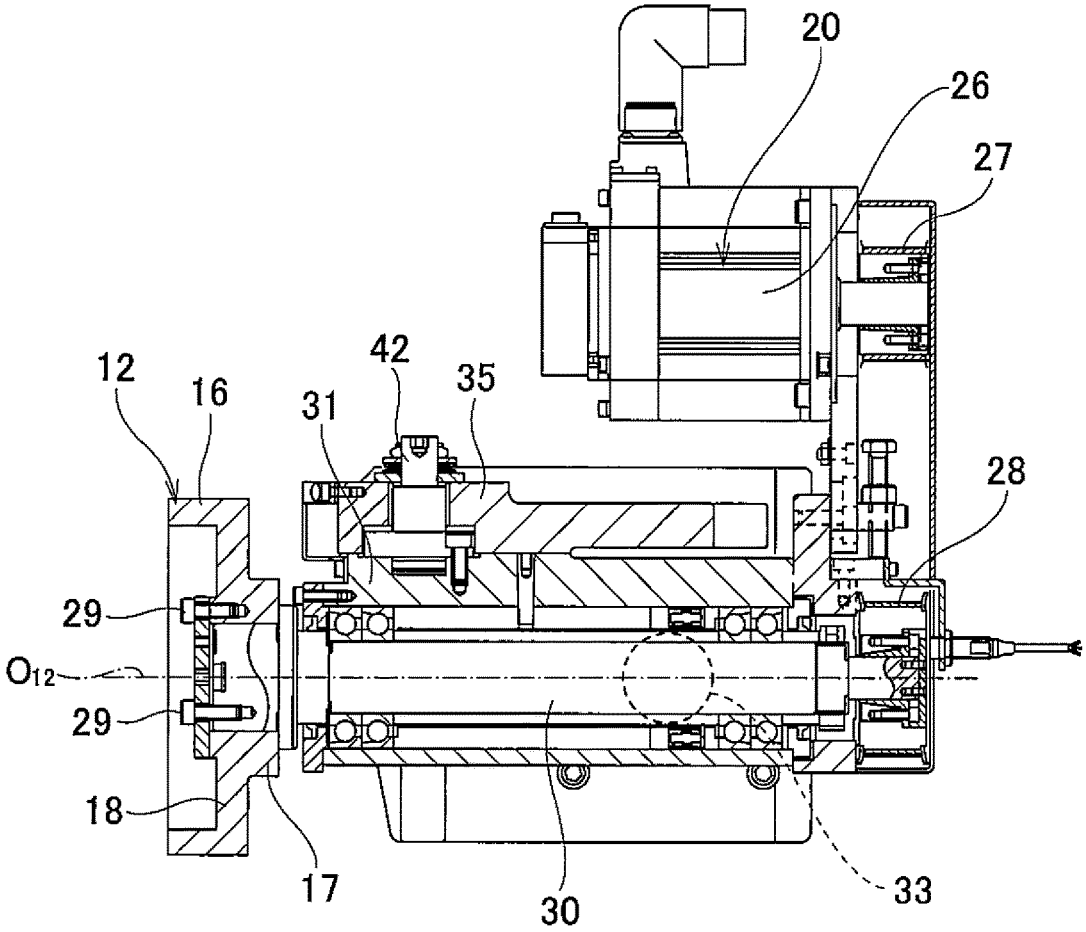
FIG. 5 is a cross-sectional view of section A-A in FIG. 4.
Figure 6:
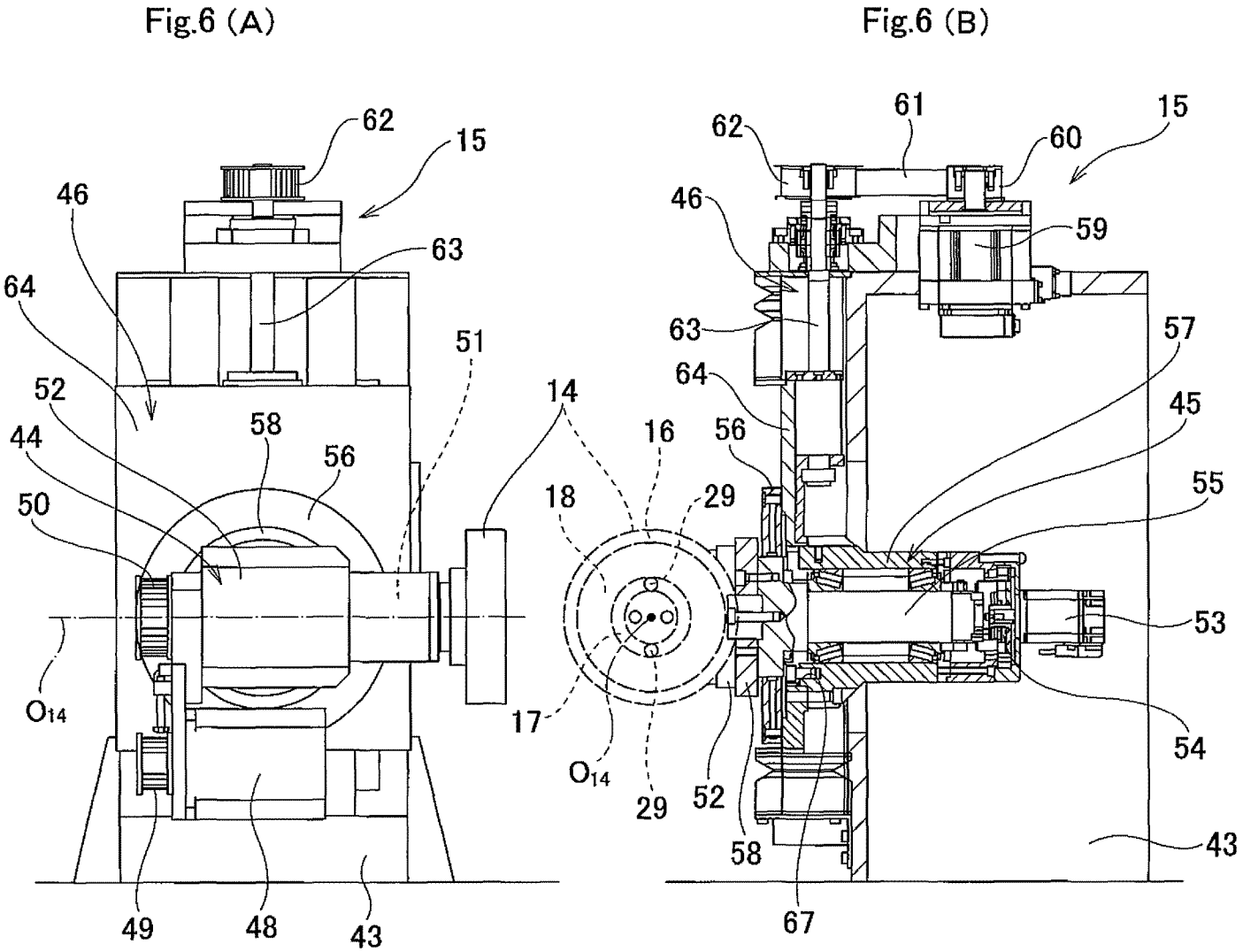
FIG. 6A is a side view illustrating the lower-roller device that has been removed from the grinding machine in FIG. 1.
FIG. 6B is a longitudinal cross-sectional view of FIG. 6A.

The rotation drive mechanism 20 has a function of rotating and driving the upper roller 12 around a center axis $O_{12}$ that is arranged in the horizontal direction (including an inclined state at a specified angle of inclination from the horizontal direction due to operation of the turn angle adjustment mechanism 21). As illustrated in FIG. 5, the rotation drive mechanism 20 comprises: a rotation drive motor 26, which is a servo motor; a drive-side pulley 27 that is fastened to the output shaft of the rotation drive motor 26; a driven-side pulley 28 with a belt that extends between the drive-side pulley 27 and driven-side pulley 28; and a rotating spindle 30, one end in the axial direction of which is fastened to the driven-side pulley 28, and the other end in the axial direction of which is fastened to the upper roller 12 by plural bolts. The rotating spindle 30 is supported inside a movable housing 31 by plural rolling bearings so as to be able to rotate freely. The rotation drive mechanism 20 transmits the rotational force of the rotation drive motor 26 to the rotating spindle 30 by the drive-side pulley 27 and driven-side pulley 28, and causes the upper roller 12 to roll in a specified direction at a specified speed.

The turn angle adjustment mechanism 21 has a function of changing the inclination angle of the center axis $O_{12}$ of the upper roller 12 with respect to the horizontal direction by rotating the center axis $O_{12}$ of the upper roller 12 around a rotation shaft 33 that is arranged in a position that is orthogonal to the center axis $O_{12}$ of the upper roller 12, and part thereof is placed inside the support frame 25. The turn angle adjustment mechanism 21 comprises: a turn angle adjustment motor 32, which is a servo motor; a reducer (not illustrated in the figure) that reduces the speed and increases the torque of the rotational force of the turn angle adjustment motor 32; a rotation shaft 33 that is rotated and driven by the reducer; and a clamp device (not illustrated in the figure) that positions the rotation shaft 33 in the circumferential direction. The rotation shaft 33 is supported inside a housing 34 by plural rolling bearings so as to be able to rotate freely, and the tip-ends section of the rotation shaft 33 supports the movable housing 31 of the rotation drive mechanism 20 by an installation plate 35 that is bent into an L-shape and a skew shaft 42. Moreover, the clamp device fastens the rotation shaft 33 by using air pressure, and prevents the rotation shaft 33 from rotating. The turn angle adjustment mechanism 21 is able to adjust the inclination angle of the center axis $O_{12}$ of the upper roller 12 with respect to the horizontal direction by rotating the turn angle adjustment motor 32 and rotating the rotation shaft 33 by just a specified angle; for example within a range of a maximum of ±20 degrees.

The vertical position adjustment mechanism 22 has a function of adjusting the height position in the vertical direction of the upper roller 12, and comprises: a vertical position adjustment motor 36, which is a servo motor; a drive-side pulley 37 that is fastened to the output shaft of the vertical position adjustment motor 36; a driven-side pulley 38 with a belt (not illustrated in the figure) that extends between the drive-side pulley 37 and driven-side pulley 38; a ball screw shaft 39, one end section in the axial direction of which is fastened to the driven-side pulley 38; and a slide plate 40 having a screw nut (not illustrated in the figure) that screws onto the ball screw shaft 39. The ball screw shaft 39 is supported on the top section of the support frame 25 by plural rolling bearings (not illustrated in the figure) so as to only be able to rotate. Moreover, the slide plate 40 is supported by the support frame 25 via linear guides which are provided between the side edges of a pair of raised wall sections of the support frame 25 and the side plate 40 so as to be able to move only in the vertical direction, which is the axial direction of the ball screw 39 (slight inclined direction with respect to the vertical direction). The slide plate 40 has a substantially rectangular plate shape, and the housing 34 of the turn angle adjustment mechanism 21 is supported inside a through hole (not illustrated in the figure) that is formed in the center of the slide plate 40. The vertical position adjustment mechanism 22, by causing the vertical position adjustment motor 33 to rotate, is able to adjust the height position in the vertical direction of the upper roller 12, for example, within a range of ±several tens of centimeters. Moreover, a clamp device is not provided in the vertical position adjustment mechanism 22, so the vertical position of the upper roller 12 is not secured by a clamp. Therefore, when the workpiece W is held between the upper roller 12 and lower roller 14, a force pressing downward from the upper roller 12 is always applied to the workpiece W. Consequently, during the grinding process, the size of the pressing force is adjusted by controlling the torque of the vertical position adjustment motor 33. In order to apply the force pressing downward to the workpiece W, it is also possible to use the weight of the upper roller 12 itself, or to use a separately provided air cylinder or the like.

The skew angle adjustment mechanism 23 comprises: a skew shaft 42 the tip-end section of which is fastened to the top section of the movable housing 31 of the rotation drive mechanism 20 in a state that the middle section thereof is supported by the top plate section of the installation plate 35 so as to be able to rotate; a skew angle adjustment motor (servo motor) (not illustrated in the figure) for rotating and driving the skew shaft 42; and a reducer (not illustrated in the figure) that reduces the speed of the rotation force and increases the torque of the skew angle adjustment motor. The skew shaft 42 is arranged in a direction orthogonal to the center axis $O_{12}$ of the upper roller 12, or in other words, in a direction parallel to the ball screw shaft 39. With this kind of construction, by causing the skew angle adjustment motor to rotate, it is possible to adjust the skew angle of the upper roller 12 around the center axis of the skew shaft 42 within a range, for example, of ±10°. In this example, when the skew angle adjustment motor is rotated, the turn angle adjustment mechanism 21 and the vertical position adjustment mechanism 22 are not rotated (displaced). In this example, by the skew angle adjustment mechanism 23 having this kind of construction adjusting the skew angle of the upper roller 12, it becomes possible to generate a specified large thrust on the workpiece W toward the backing plate 5*a* side, and to position the workpiece W in the axial direction. Moreover, in the skew angle adjustment mechanism 23 of this example, it is also possible to omit the skew angle adjustment motor and reducer. In that case, the worker adjusts the skew angle of the upper roller 12 by directly rotating the skew shaft 42.

The lower-roller device 15 comprises: a substantially rectangular frame shaped base 43 that is fastened to the floor in a raised state in the vertical direction; a rotation drive mechanism 44, a turn angle adjustment mechanism 45, a vertical position adjustment mechanism 46, and an installation arm section 47; however, differing from the upper-roller device 13, there is no skew angle adjustment mechanism. The lower roller mechanism 15 supports the lower roller 14 further below the upper roller 12 that is supported by the upper-roller device 13.

The rotation drive mechanism 44 has a function of rotating and driving the lower roller 14 around the center axis $O_{14}$ that is arranged in the horizontal direction (including an inclined state at a specified angle from horizontal direction due to operation of the turn angle adjustment mechanism 45). The rotation drive mechanism 44, as illustrated in FIG. 6A, comprises: a rotation drive motor 48, which is a servo motor; a drive-side pulley 49 that is fastened to the output shaft of the rotation drive motor 48; a driven-side pulley 50 around which a belt (not illustrated in the figure) is placed that extends between the drive-side pulley 49 and driven-side pulley 50; and a rotating spindle 51, one end section in the axial direction thereof being fastened to the driven side pulley 50, and the other end section in the axial direction thereof being fastened to the lower roller 14 by plural bolts 29. The rotating spindle 51 is supported inside a movable housing 52 by plural rolling bearings. The rotation drive mechanism 44 transmits the rotational force of the rotation drive motor 48 to the rotating spindle 51 by the drive-side pulley 49 and driven-side pulley 50, and causes the lower roller 14 to rotate in the same direction and at the same speed as the upper roller 12. In this example, the rotation drive motor 48 for rotating the lower roller 14 and the rotation drive motor 26 for rotating the upper roller 12 are provided separately, so it is necessary to prevent a difference between the rotational speeds of the upper roller 12 and the lower roller 14, so synchronization control is performed for the rotation drive motors 26, 48 as servo motors.

The turn angle adjustment mechanism 45 has a function of changing the inclination angle of the center axis $O_{14}$ of the lower roller 14 with respect to the horizontal direction by rotating the center axis $O_{14}$ around the rotation shaft 55 that is located in a position that is orthogonal to the center axis $O_{14}$ of the lower roller 14, and part is placed on the inside of the base 43. This kind of turn angle adjustment mechanism 45 comprises: a turn angle adjustment motor 53, which is a servo motor; a reducer 54 that reduces the speed of the rotational force and increases the torque of the turn angle adjustment motor 53; a rotation shaft 55 that is rotated and driven by the reducer 54; and a clamp device 56 that positions the rotation shaft 55 in the circumferential direction. The rotation shaft 55 is supported on the inside of a housing 57 by plural rolling bearings so as to be able to rotate freely, and the tip-end section thereof supports the movable housing 52 of the rotation drive mechanism 44 via an installation plate 58. The clamp device 56 clamps the rotation shaft 55 using air pressure and prevents the rotation shaft 55 from rotating. The turn angle adjustment mechanism 45 is able to adjust the inclination angle of the center axis $O_{14}$ of the lower roller 14 with respect to the horizontal direction within a range, for example, of a maximum of 20 degrees, by causing the turn angle adjustment motor 53 to rotate and rotating the rotation shaft 55 just a specified angle.

The vertical position adjustment mechanism 46 has a function of adjusting the height position in the vertical direction of the lower roller 14, and comprises: a vertical position adjustment motor 59, which is a servo motor, that is supported on the top section of the base 43; a drive-side pulley 60 that is fastened to the output shaft of the vertical position adjustment motor 59; a driven-side pulley 62, around which a belt 61 is placed that extends between the drive-side pulley 60 and driven-side pulley 62; a ball screw shaft 63, one end section thereof being fastened to the driven-side pulley 62; a slide plate 64 having a screw nut (not illustrated in the figure) that screws onto the ball screw shaft 63; and a guide clamp device (not illustrated in the figure) that is able to position the slide plate in the vertical direction. The ball screw shaft 63 is supported on the top section of the base 43 by plural rolling bearings so as to be able to only rotate. The slide plate 64 is supported by linear guides 65 that are provided between the side edges of a pair of raised wall sections of the base 43 and the slide plate 64 so as to be able to move only in the up-down direction (vertical direction), which is the axial direction of the ball screw shaft 63. The slide plate 64 has a substantially rectangular plate shape, and supports the housing 57, which supports the rotation shaft 55 of the turn angle adjustment mechanism 45, inside a through hole 67 that is formed in a portion near the bottom of the slide plate 64. By causing the vertical position adjustment motor 59 to rotate, the vertical position adjustment mechanism 46 is able to adjust the height position in the vertical direction of the lower roller 14 within a range, for example, of ±several tens of centimeters.

The installation arm section 47 is fastened to the middle section in the vertical direction of the raised wall section of the base 43, and provided in a state so as to extend in the horizontal direction toward the upper-roller device 13 side. A backing plate 5*a* is fastened to the tip-end section of the installation arm section 47 for supporting the end surface in the axial direction of the workpiece W, and the shoe 4*a* for supporting the workpiece W from the side is supported by the middle section of the installation arm section 47.

In this example, the rotation drive mechanism 20, the turn angle adjustment mechanism 21, vertical position adjustment mechanism 22 and skew angle adjustment mechanism 23 of the upper-roller device 13, and the rotation drive mechanism 44, the turn angle adjustment mechanism 45, and vertical position adjustment mechanism 46 of the lower-roller device 15 are all controlled by a controller 66. More specifically, the controller 66 controls the rotation drive motors 26, 48 of the rotation drive mechanisms 20, 44, which makes it possible to match the direction of rotation and rotational speed of the upper roller 12 and lower roller 14. Moreover, by inputting the outer diameter or inclined state (whether or not there is inclination with respect to the center axis, and the angle when there is inclination) of the generation line of the workpiece W to the controller 66, it is possible, according to that input, to respectively cause the vertical position adjustment motors 36, 59 of the vertical position adjustment mechanisms 22, 46, and the turn angle adjustment motors 32, 53 of the turn angle adjustment mechanisms 21, 45 to rotate specified amounts in specified directions, and automatically adjust the height position in the vertical direction of the upper roller 12 and lower roller 14, and the inclination angle of the center axes $O_{12}$, $O_{14}$ of the upper roller 12 and lower roller 14 with respect to the horizontal direction. Furthermore, by inputting the amount of pressure force for pressing the workpiece W toward the backing plate 5*a* to the controller 66, it is possible to automatically adjust the skew angle of the upper roller 12 by causing the skew angle adjustment motor of the skew angle adjustment mechanism 23 to rotate just a specified amount in a specified direction.

When performing grinding work using the grinding machine 1*a* of this example, required information such as the outer diameter or the inclination state of the generating line, the size of the pressure force, and the like are inputted to the controller 66 in advance for each of plural types of workpieces W. Then, before starting the grinding work, a program is called up according to the type of workpiece W, and the height position in the vertical direction of the upper roller 12 and lower roller 14, the inclination angle with respect to the horizontal direction of the center axes $O_{12}$, $O_{14}$ of the upper roller 12 and lower roller 14, and the skew angle are automatically adjusted. Next, a workpiece W is automatically supplied by workpiece supply means (not illustrated in the figure) to a processing position that is surrounded by the upper roller 12, lower roller 14, shoe 4*a* and backing plate 5*a*. Then, with the workpiece W held in the processing position, the workpiece W is rotated, and by adjusting the vertical position of the upper roller 12 by torque control of the vertical position adjustment motor 36, the pressure force of the upper roller 12 on the workpiece W is adjusted. Moreover, by moving the X-Y table 11, the rotating cup grindstone 9 is brought close to the workpiece W and an end surface of the workpiece W (or circumferential surface) of the workpiece W is ground.

Figure 7C:
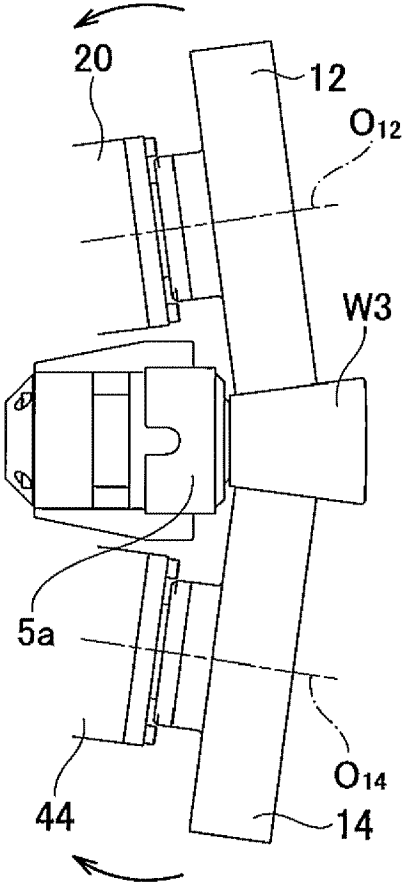
FIGS. 7A to 7C are views illustrating the state of performing a grinding process on three kinds of workpieces using the grinding machine of this example.
Figure 7B:
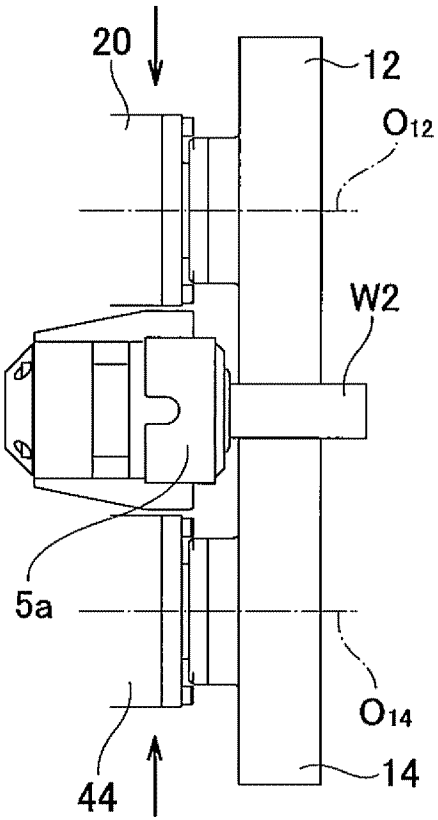
Figure 7A:
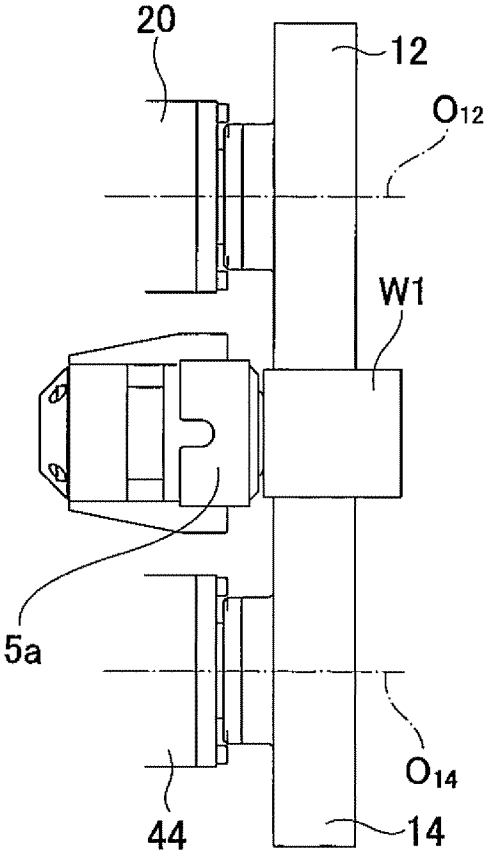
Figure 8:
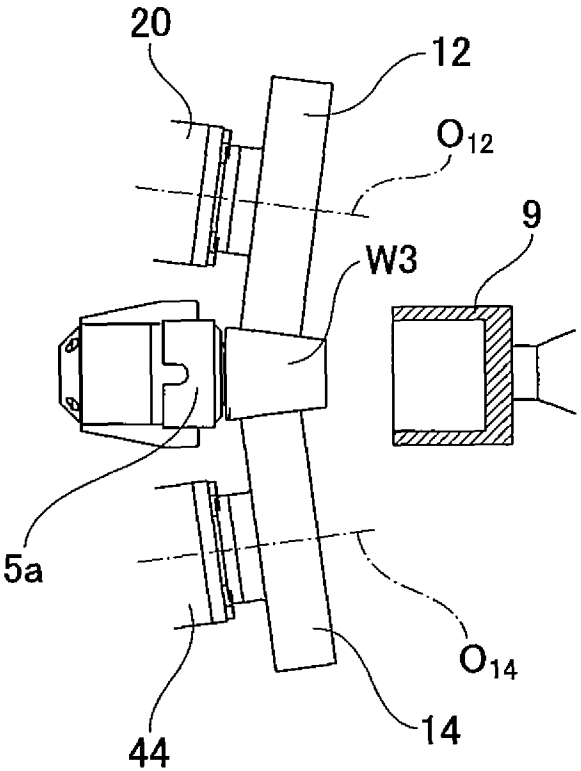
FIGS. 8A and 8B are views illustrating the state of performing a grinding process on the large-diameter-side end surface and small-diameter-side end surface of a workpiece.
Figure 8:
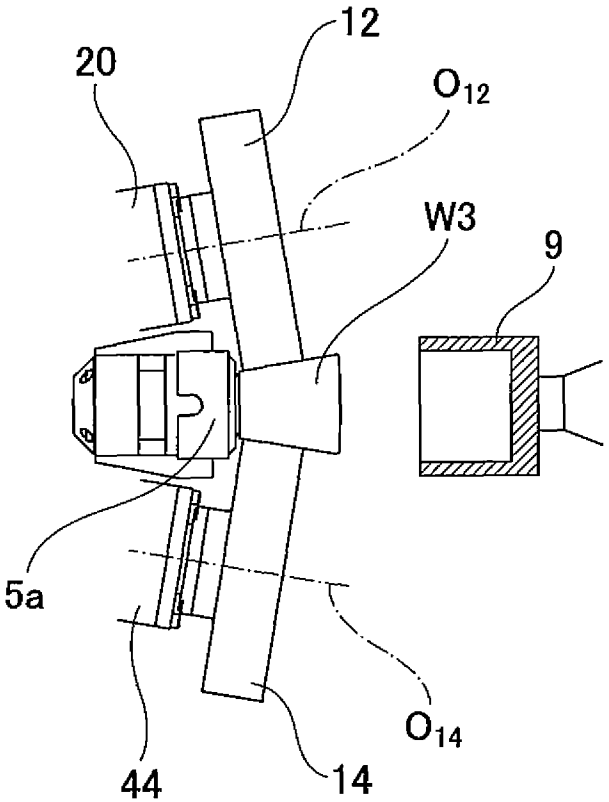
Figure 9:
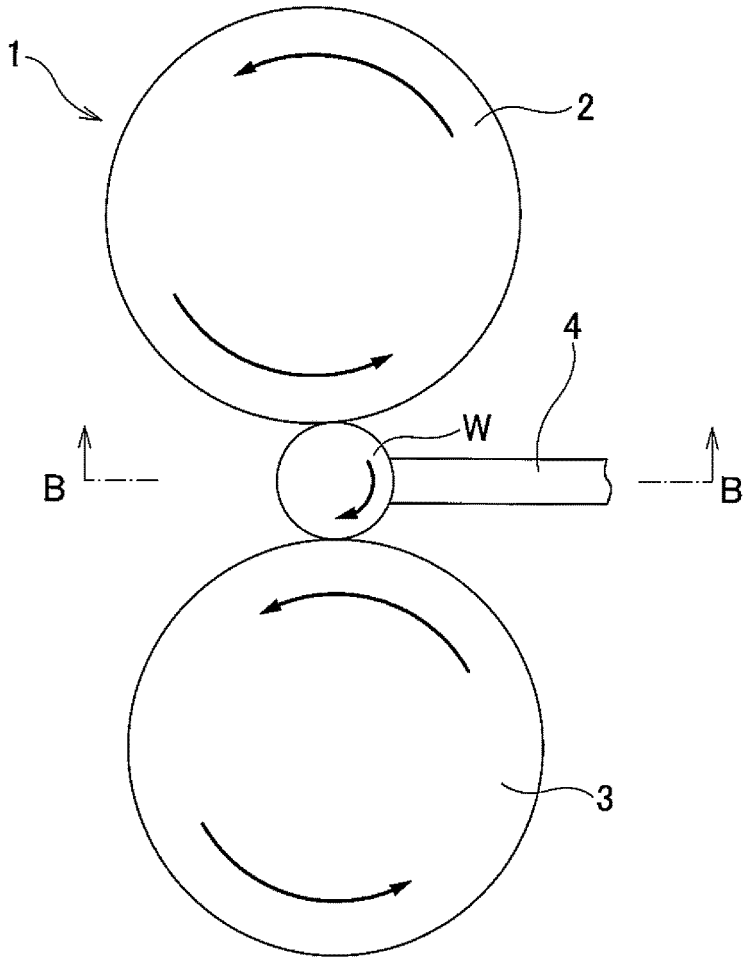
FIG. 9 is a schematic view illustrating the main parts of an example of conventional construction of a 2 roller 1 shoe type of grinding machine.
Figure 10:
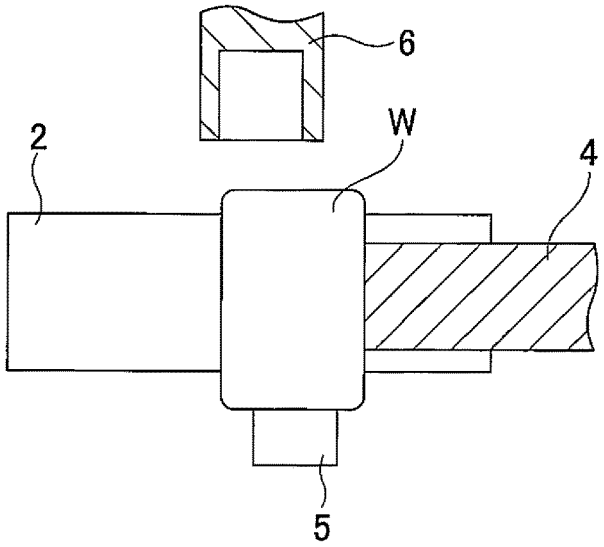
FIG. 10 is a cross-sectional view of section B-B in FIG. 9.
Figure 11:
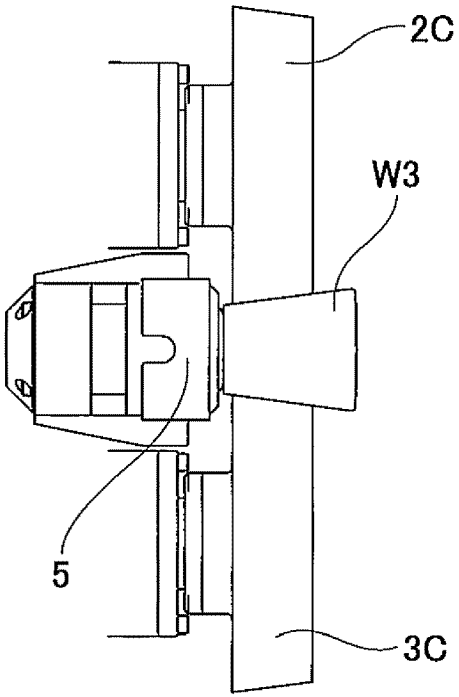
FIGS. 11A to 11C are views illustrating the state of performing a grinding process on three kinds of workpieces using a grinding machine having conventional construction.
Figure 11:
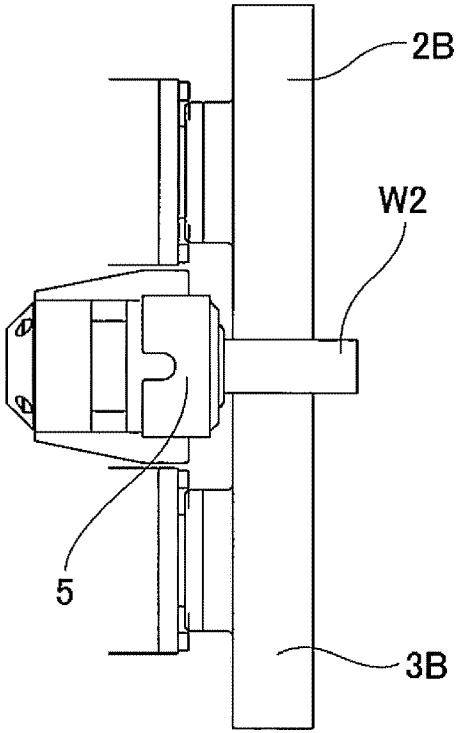
Figure 11:
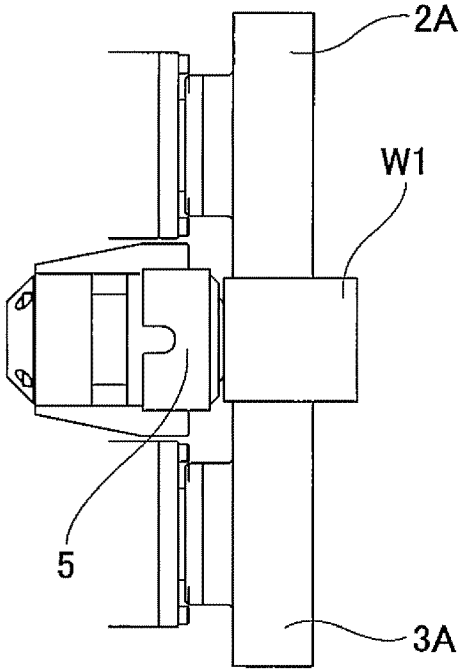

With the grinding machine 1*a* of this example, even when the outer diameters or inclination states of the generating lines of the workpieces W to be ground differ, it is not necessary to replace the upper roller 12 and lower roller 14, and thus it is possible to make the upper roller 12 and lower roller 14 common. In other words, in the grinding machine 1*a* of this example, vertical position adjustment mechanisms 22, 46 are provided, so it is possible to suitably change the height position in the vertical direction of the upper roller 12 and lower roller 14 according to the outer diameter of the workpiece W. As illustrated in FIG. 7A, after performing grinding work by holding a large-diameter circular column shaped workpiece W1 by the upper roller 12 and lower roller 14, by moving the upper roller 12 further downward and moving the lower roller 14 upward than the position where the workpiece W1 was held, it is possible to hold a small-diameter circular column shaped workpiece W2 as illustrated in FIG. 7B. In this way, in this example, even when the outer diameter of workpieces W differ, it is not necessary to perform replacement work to replace the upper roller 12 and lower roller 14.

In the grinding machine 1*a* of this example, turn angle adjustment mechanisms 21, 45 are provided, so it is possible to suitably change the inclination angle with respect to the horizontal direction of the center axes O12, O14 of the upper roller 12 and lower roller 14 according to the inclination state of the generating line of the workpiece W. As illustrated in FIG. 7A, after performing grinding work by holding a large-diameter circular column shaped workpiece W1 by the upper roller 12 and lower roller 14, by changing the inclination angle with respect to the horizontal direction of the center axis $O_{12}$ and the center axis $O_{14}$ around the rotation shafts 33, 55 from the position where the workpiece W1 was held in a direction separating the upper roller 12 and lower roller 14, it is possible to hold a conic trapezoidal shaped workpiece W3 as illustrated in FIG. 7C. Moreover, as illustrated in FIGS. 8A, 8B, even when grinding the end surface on the large-diameter side and the end surface on the small-diameter side of a conic trapezoidal shaped workpiece W3, by changing the respective inclination angles with respect to the horizontal direction of the center axis $O_{12}$ and center axis $O_{14}$, it is possible to hold the workpiece W3. In this way, in this example, even when the inclination states of the generating lines of workpieces W differ, it is not necessary to perform replacement work to replace the upper roller 12 and lower roller 14.

In this example, it is not necessary to prepare plural upper rollers and lower roller according to the outer diameters or inclination states of the generating lines of the workpieces W, and it is possible to make the upper roller 12 and lower roller 14 common, so even when the outer diameters or inclination states of the generating lines of workpieces W differ, it is not necessary to perform replacement work to replace the upper roller 12 and lower roller 14. Therefore, it is possible to keep down manufacturing costs by the amount that the number or required upper rollers and lower rollers is reduced, and it is possible to reduce the number of processing steps and the amount of work time.

The height in the vertical direction of the upper roller 12 and lower roller 14, and the inclination angle with respect to the horizontal direction of the center axes $O_{12}$, $O_{14}$ of the upper roller 12 and lower roller 14 can be changed automatically by using servo motors, so it is possible to reduce the work load and work time of the workers. Furthermore, it is possible to control the pressure force of the upper roller 12 on the workpiece W by using torque control of the vertical position adjustment motor 36 of the vertical position adjustment mechanism 22 of the upper roller 12. Therefore, in order to change the pressure force, it is not necessary to perform spring replacement, or to provide a special mechanism for changing the pressure force. Consequently, it is possible to prevent an increase in the size of the grinding machine 1*a*, and it is possible to suppress an increase in costs.

Furthermore, the upper roller 12 and lower roller 14 move in directions opposite each other when the vertical position adjustment mechanisms 22, 46 are operated. Therefore, by using different ball screw shafts in the lead direction for the upper-roller device 13 and the lower-roller device 15, it is also possible to change the height position in the vertical direction of the upper roller 12 and lower roller 14 by using one servo motor. Moreover, the pulley devices (drive-side pulley, driven-side pulley and belt) and reducer that are used in the upper-roller device 13 and lower-roller device 15 can be interchangeably used. In addition, in regard to the vertical position adjustment mechanisms 22, 46, instead of a ball screw mechanism that comprises a ball screw shaft and screw nut, it is also possible to use a rack-and-pinion type linear motion mechanism. Furthermore, the skew angle of the upper roller 12 can be adjusted manually by rotating the skew shaft 42. The other construction and effects are the same as in the conventional construction.

EXPLANATION OF REFERENCE NUMBERS

W, W1 to W3 Workpiece
1, 1*a* Grinding machine
2, 2A to 2C Upper roller
3, 3A to 3C Lower roller
4, 4*a* Shoe
5, 5*a* Backing plate
6 Grindstone
7 Headstock
8 Grindstone base
9 Cup grindstone
10 Grindstone spindle
11 X-Y table
12 Upper roller
13 Upper-roller device
14 Lower roller
15 Lower-roller device
16 Large-diameter cylindrical section
17 Small-diameter cylindrical section
18 Stepped section
19 Base
20 Rotation drive mechanism
21 Turn angle adjustment mechanism
22 Vertical position adjustment mechanism
23 Skew angle adjustment mechanism
24 Pedestal
25 Support frame
26 Rotation drive motor
27 Drive-side pulley
28 Driven-side pulley
29 Bolt
30 Rotating spindle
31 Movable housing
32 Turn angle adjustment motor
33 Rotation shaft
34 Housing
35 Installation plate
36 Vertical position adjustment motor
37 Drive-side pulley
38 Driven-side pulley
39 Ball screw shaft
40 Slide plate
41 Linear guide
42 Skew shaft
43 Base
44 Rotation drive mechanism
45 Turn angle adjustment mechanism
46 Vertical position adjustment mechanism
47 Installation arm section
48 Rotation drive motor
49 Drive-side pulley
50 Driven-side pulley
51 Rotating spindle
52 Movable housing
53 Turn angle adjustment motor
54 Reducer
55 Rotation shaft
56 Clamp device
57 Housing
58 Installation plate
59 Vertical position adjustment motor
60 Drive-side pulley
61 Belt
62 Driven-side pulley
63 Ball screw shaft
64 Slide plate
65 Linear guide
66 Controller
67 Through hole

What is claimed is:

1. A grinding machine for performing a grinding process on a circumferential surface or end surface of a workpiece, the circumferential surface of the workpiece having a circular cross sectional shape;

the grinding machine comprising:

an upper roller and lower roller rotating in a same direction as each other in a state that the upper roller and the lower roller support the workpiece from both upper and lower sides, to rotate the workpiece;

a shoe positioned in a vertical direction between the upper roller and the lower roller, having a tip-end surface, and supporting the workpiece from a lateral side by abutting the tip-end surface against the outer-circumferential surface of the workpiece; and a grindstone for performing the grinding process on the circumferential surface or the end surface of the workpiece, wherein the grinding machine further comprises:

a vertical position adjustment mechanism for respectively changing a height position in the vertical direction of both the upper roller and the lower roller; and an angle adjustment mechanism for respectively changing an inclination angle with respect to a horizontal direction of center axes of both the upper roller and the lower roller.

2. The grinding machine according to claim 1, wherein the vertical position adjustment mechanism and the angle adjustment mechanism respectively comprise a servo motor, and automatically change the height positions in the vertical direction of the upper roller and the lower roller, and change the inclination angles with respect to the horizontal direction of the center axes of the upper roller and the lower roller according to an outer diameter and inclination state of a generating line of the workpiece.

3. The grinding machine according to claim 2, wherein the vertical position adjustment mechanism controls a pressure force of the upper roller on the workpiece by using torque control to control a torque of the servo motor of the vertical position adjustment mechanism.

4. The grinding machine according to claim 1, wherein the vertical position adjustment mechanism and the angle adjustment mechanism automatically change the inclination angles with respect to the horizontal direction of the center axes of the upper roller and the lower roller according to an outer diameter and inclination state of a generating line of the workpiece to allow the workpiece to rotate around a rotation axis arranged in the horizontal direction.

5. The grinding machine according to claim 1, wherein the grinding machine further comprises a skew angle adjustment mechanism for adjusting a skew angle of the upper roller around a center axis of a skew shaft, which is arranged in a direction orthogonal to the center axis of the upper roller.

6. The grinding machine according to claim 1, wherein the vertical position adjustment mechanism comprises:

a first mechanism that moves the upper roller in the vertical direction; and a second mechanism that moves the lower roller in the vertical direction.

7. The grinding machine according to claim 1, further comprising a positioning mechanism that moves the grindstone in a horizontal plane relative to the upper and lower rollers.

* * * * *